US007861659B2

(12) United States Patent
Gillis et al.

(10) Patent No.: US 7,861,659 B2
(45) Date of Patent: Jan. 4, 2011

(54) LIGHTWEIGHT HOPPER CAR WITH THROUGH CENTER SILL

(75) Inventors: Michael Gillis, Portland, OR (US); Gregory J. Saxton, Portland, OR (US); Marvin Gordon Rains, Tualatin, OR (US)

(73) Assignee: Gunderson LLC, Portland, OR (US)

( * ) Notice: Subject to any disclaimer, the term of this patent is extended or adjusted under 35 U.S.C. 154(b) by 383 days.

(21) Appl. No.: 11/789,215

(22) Filed: Apr. 23, 2007

(65) Prior Publication Data

US 2008/0035014 A1 Feb. 14, 2008

Related U.S. Application Data

(60) Provisional application No. 60/794,271, filed on Apr. 21, 2006, provisional application No. 60/867,169, filed on Nov. 24, 2006, now abandoned.

(51) Int. Cl.
*B61D 3/00* (2006.01)

(52) U.S. Cl. ..... 105/248; 105/247; 105/249; 105/413

(58) Field of Classification Search ..... 105/247, 105/248, 249, 413
See application file for complete search history.

(56) References Cited

U.S. PATENT DOCUMENTS 1,950,001 A * 3/1934 Gilpin et al. ..... 105/249
2,079,862 A 5/1937 Kiesel, Jr.
2,092,457 A 9/1937 Kiesel, Jr.
3,040,679 A 6/1962 Warntz
3,339,499 A 9/1967 Charles et al.
3,490,387 A 1/1970 Halcomb
3,495,548 A 2/1970 Rollins
3,509,827 A 5/1970 Sutter
3,515,051 A 6/1970 Pulcrano
3,538,857 A * 11/1970 Mowatt-Larssen ..... 105/247
3,557,713 A 1/1971 Spence et al.
3,570,592 A 3/1971 Rollins
3,577,932 A 5/1971 Pulcrano et al.
3,583,330 A 6/1971 Freudman
3,583,331 A 6/1971 Mowatt-Larssen
3,584,564 A 6/1971 Rollins
3,675,591 A 7/1972 Nagy et al.
3,789,773 A 2/1974 McNalley et al.
3,918,370 A 11/1975 Campbell et al.
3,921,537 A 11/1975 Fleshman et al.
4,003,319 A 1/1977 Campbell et al.

(Continued)

*Primary Examiner*—S. Joseph Morano
*Assistant Examiner*—Jason C Smith
(74) *Attorney, Agent, or Firm*—Chernoff, Vilhauer, McClung & Stenzel

(57) ABSTRACT

A lightweight hopper car that includes one or more reinforcing members at specified locations, so that the hopper car has both a carrying capacity and a structural strength comparable to those of existing, heavier hopper cars. Specifically, the present application discloses that the hopper car may be reinforced at one or more locations including (i) at selective intersections between the center sill and slope sheets of cargo wells; (ii) between side slope sheets of adjacent cargo wells; (iii) at the junction between the side sheets and end slope sheets of the hopper car; and (iv) along the end combing seal between opposed carlines, if the hopper car is covered. In addition, the present application discloses a novel means of reinforcing side sheets of a rail car, including hopper cars, against the warping that commonly occurs when welding the side sheets at the car is fabricated.

15 Claims, 9 Drawing Sheets

U.S. PATENT DOCUMENTS 4,168,665 A 9/1979 Needham et al.
4,232,989 A * 11/1980 Miller ..... 414/387
4,262,602 A 4/1981 Patil et al.
4,292,898 A 10/1981 Gordon et al.
4,334,481 A 6/1982 Przybylinski et al.
4,352,331 A 10/1982 Anderson et al.
4,366,757 A 1/1983 Funk
4,377,058 A * 3/1983 Hallam et al. ..... 52/45
4,484,528 A * 11/1984 Anderson et al. ..... 105/248
4,493,266 A * 1/1985 Augustine, Jr. ..... 105/255
4,497,258 A 2/1985 Ruhmann et al.
4,498,400 A 2/1985 Vorwerk et al.
4,598,646 A 7/1986 Dugge et al.
4,608,931 A 9/1986 Ruhmann et al.
4,630,548 A * 12/1986 Wiger et al. ..... 105/416
4,638,743 A * 1/1987 Loomis ..... 105/377.07
4,696,088 A * 9/1987 Miller ..... 29/401.1
4,741,274 A 5/1988 Ferris et al.
4,875,417 A 10/1989 Coulborn et al.
4,884,511 A * 12/1989 Hallam et al. ..... 105/247
4,893,568 A * 1/1990 Adams ..... 105/416
4,898,101 A 2/1990 Harter
4,922,833 A 5/1990 Coulborn et al.
4,930,427 A 6/1990 Ritter et al.
4,941,411 A 7/1990 Wong
4,966,081 A 10/1990 Dominguez et al.
5,144,895 A 9/1992 Murray
5,159,882 A 11/1992 Krug et al.
5,259,322 A * 11/1993 Dominguez et al. ..... 105/4.1
5,263,421 A 11/1993 Lichty et al.
5,279,230 A * 1/1994 Thomas et al. ..... 105/355
5,367,958 A 11/1994 Weiss et al.
5,390,607 A 2/1995 Lydic
5,584,252 A * 12/1996 Smith et al. ..... 105/409
5,762,003 A 6/1998 Downes et al.
5,860,366 A * 1/1999 Lydic ..... 105/416
5,934,200 A 8/1999 Lydic
6,019,049 A * 2/2000 Gaydos et al. ..... 105/289
6,044,771 A * 4/2000 Nguyen ..... 105/247
6,067,912 A 5/2000 Miller
6,119,345 A 9/2000 Lydic et al.
6,164,210 A * 12/2000 Coslovi et al. ..... 105/396
6,220,502 B1 4/2001 Gallinger et al.
6,237,505 B1 5/2001 Sande et al.
6,244,191 B1 * 6/2001 Lydic ..... 105/377.07
6,257,150 B1 * 7/2001 Burke ..... 105/247
6,276,058 B1 8/2001 Gallinger et al.
6,279,217 B1 8/2001 Gallinger et al.
6,279,487 B1 * 8/2001 Gaydos et al. ..... 105/289
6,502,518 B1 * 1/2003 Miller ..... 105/248
6,604,469 B1 8/2003 Galvan et al.
2002/0157563 A1 10/2002 Richmond et al.
2004/0244638 A1 12/2004 Taylor
2005/0056185 A1 * 3/2005 Herzog et al. ..... 105/286
2005/0056186 A1 * 3/2005 Creighton et al. ..... 105/286
2008/0035014 A1 * 2/2008 Gillis et al. ..... 105/248
2009/0241799 A1 10/2009 Saxton et al.

* cited by examiner

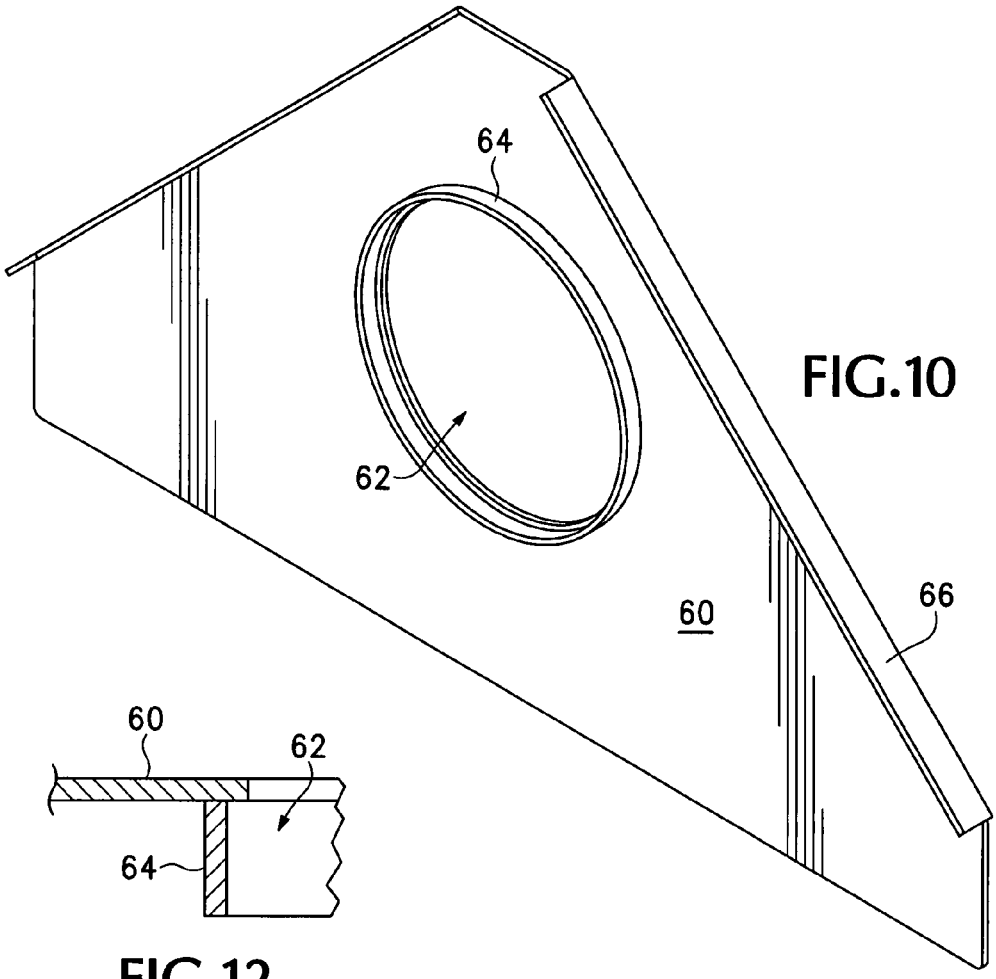
FIG.10
FIG.12
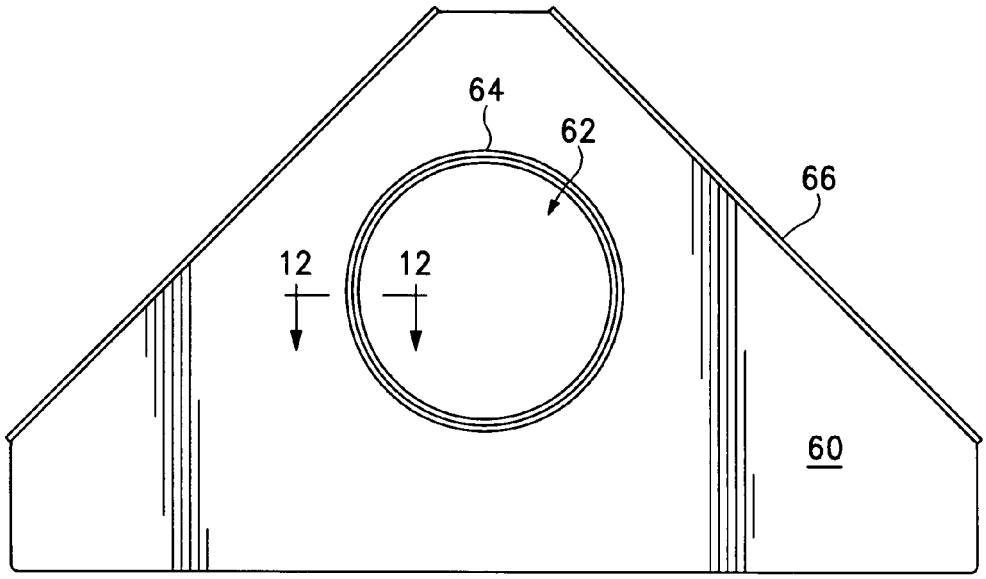
FIG.11

LIGHTWEIGHT HOPPER CAR WITH THROUGH CENTER SILL

CROSS-REFERENCE TO RELATED APPLICATIONS

The present application claims the benefit of priority to Provisional Application No. 60/794,271 filed Apr. 21, 2006 and Provisional Application No. 60/867,169 filed Nov. 24, 2006 now abandoned.

BACKGROUND OF THE INVENTION

The present disclosure relates to hopper cars, and more particularly, hopper cars having a through center sill.

To accommodate the widely varying types of cargo that may travel over a railroad, rail cars of many different designs are manufactured, and in some instances a rail car will be specially designed to carry either one specific type of cargo (e.g. automobiles carried in a freight car with multi-level decks), or cargo having a certain characteristic (e.g. perishable cargo in an insulated and/or refrigerated car). One type of cargo that is often transported via railroad is cargo having bulk fluid properties, meaning commodities that, in bulk, exhibit fluid-like behavior. Examples of such commodities are grain, nuts, etc. Although such cargo could conceivably be packaged in bags and transported by boxcar, for example, such a method would be highly inefficient. Instead, such bulk fluid cargo is typically transported in a hopper car, which is specially designed to carry cargo having bulk fluid properties.

A hopper car usually includes one or more cargo-carrying bins, called cargo wells, which may be filled with grain or other bulk fluid cargo. The cargo-carrying capacity of a typical existing hopper car is usually within the approximate range of 3200 to 6200 cubic feet and/or the range of 220,000 to 232,000 lbs. The cargo is typically poured into the hopper car from the top and discharged from the bottom. To facilitate loading a hopper car with bulk fluid cargo, the hopper car will typically include a large opening over the top of each cargo well. Although some hopper cars include covers to protect the cargo from the elements during transport, such covered hopper cars will include a large lid that may be opened to load cargo, and an uncovered hopper car may even have cargo wells that are completely open at the top.

Cargo in a hopper car is usually discharged through respective discharge outlets at the bottom of each cargo well. Each discharge outlet is selectively closeable to permit the loading and transporting of the cargo. The discharge outlets are usually located approximately at the center of the cargo well that they respectively empty. When the discharge outlet is opened, the bulk fluid cargo empties from the hopper car. To facilitate the fluid flow of cargo towards these outlets while a hopper car is being emptied, each cargo well will usually include at least one pair of opposed side walls, or slope sheets, that are each respectively slanted downwardly and inwardly towards the respective outlet at the center of the cargo well.

One specific type of hopper car is a through center sill hopper car. A hopper car, like other rail cars, is structurally supported by an undercarriage that includes a center sill oriented longitudinally along the approximate center line of the hopper car. A through center sill hopper car has a center sill that runs through the respective cargo wells of the hopper car, such that when loaded, the cargo in each cargo well will surround the center sill. In order to facilitate the flow of cargo around the center sill when the cargo is unloaded, the center sill is typically covered by a triangular hood so that the bulk fluid cargo does not collect on top of the center sill when the hopper car empties. Positioning a center sill inside the cargo wells of a hopper car reduces somewhat the cargo-carrying capacity of the hopper car.

The center sill is a primary load-bearing structural member of the hopper car, and must be of a sufficiently sturdy construction to withstand not only the substantial standing weight of both the hopper car and the cargo it carries, but also the various bending and rotational stresses that are applied to the center sill as the hopper car moves along a railroad track. The center sill is typically constructed of two sets of opposed, parallel pieces of elongate steel or other similarly rigid material, forming a square cross-section. These individual members are usually welded together along the right-angle intersections between adjacent members, and are typically fashioned of steel or other similarly rigid material ½-inch thick or greater so as to withstand the aforementioned loads and stresses. Often, the center sill is further reinforced by a plurality of gussets or other reinforcements inside the center sill. Like the center sill, other load-bearing structural members of the hopper car, such as the slope sheets, the side sills, end sills, etc. must also have sufficient strength to withstand such weight and stresses, and are likewise fashioned of steel or other material with thicknesses sufficient to withstand the loads and stresses incident to the carrying capacity of the hopper car.

Unfortunately, though required by the design of existing hopper cars, the aforementioned size and composition of the structural members, such as the center sill, substantially add to the weight of the hopper car. What is desired, therefore, is a new design for a hopper car that is lighter in weight than existing hopper cars, yet is able to durably withstand the same loads and stresses as do existing hopper cars of similar carrying capacity.

SUMMARY OF THE INVENTION

The foregoing and other objectives, features, and advantages of the invention will be more readily understood upon consideration of the following detailed description of the invention taken in conjunction with the accompanying drawings.

BRIEF DESCRIPTION OF THE DRAWINGS

FIG. 10 is an enlarged perspective view of a cargo well reinforcing member as shown in FIG. 2.

FIG. 11 is a front view of the cargo well reinforcing member of FIG. 10.

FIG. 12 is a sectional view of the cargo well reinforcing member of FIG. 10 taken along line 12-12 of FIG. 11.

DETAILED DESCRIPTION OF PREFERRED EMBODIMENTS

Figure 1A:
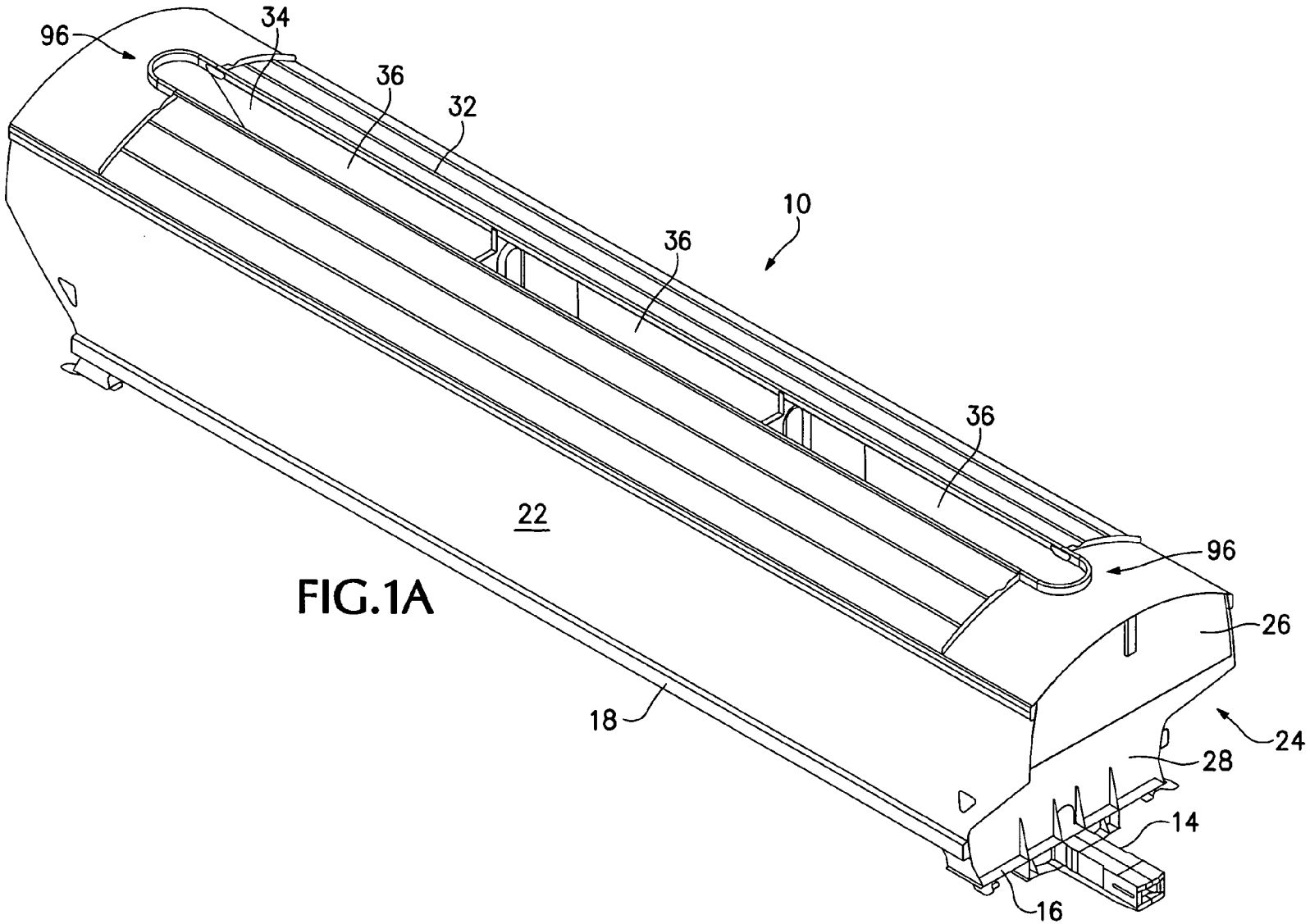
FIG. 1A is a perspective view of a novel lightweight hopper car constructed in accordance with the disclosure of the present application.

Referring to FIGS. 1A, 1B, 2, and 3, the present specification discloses an exemplary covered hopper car 10 supported on an undercarriage 12 that may include a center sill 14, end sills 16, and side sills 18. The hopper car 10 is capable of transport over a rail line via truck/wheel assemblies (not shown) and may include one or more universal couplers used to connect the hopper car 10 serially with other rail cars of assorted designs and manufacture. The hopper car 10 also may include an outer structure comprising plural side sheets 22 and end sheet assemblies 24 comprising upper and lower bulkheads 26 and 28, respectively, as well as end slope sheets 38 as later described. The hopper car 10 may include a roof 32 defining an opening 34 into one or more cargo wells 36. It should be understood that, although the hopper car 10 is covered, embodiments of the disclosed hopper car as herein described and/or claimed may be uncovered.

Figure 1B:
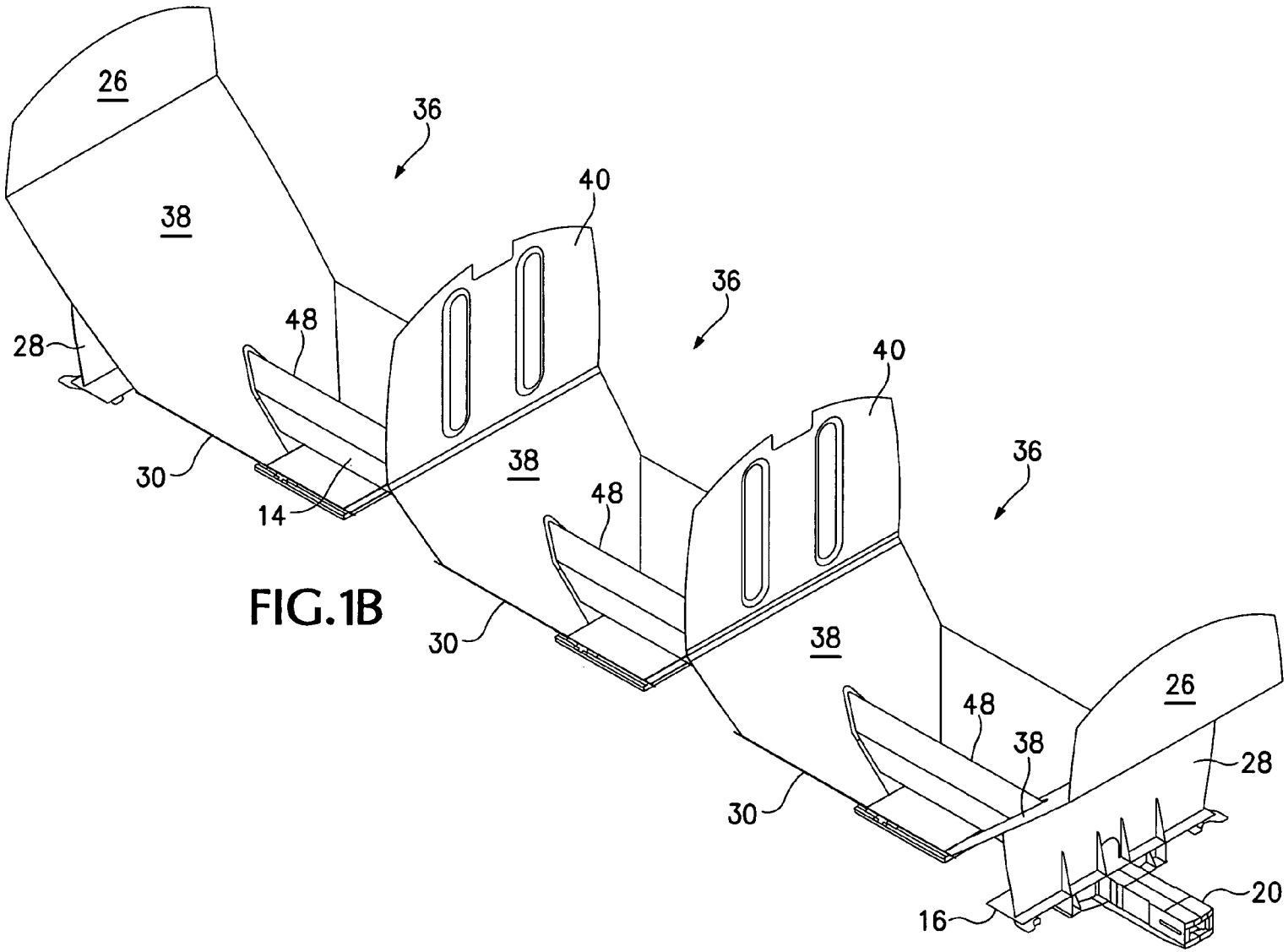
FIG. 1B is a perspective view of the cargo wells of the hopper car of FIG. 1 with the side sheets removed.

The hopper car 10 may include a plurality of cargo wells 36. Although the exemplary hopper car 10 includes three such cargo wells, hopper cars having a different number of cargo wells may easily be constructed in accordance with the disclosure contained in this specification. Each cargo well 36 may be enclosed at each of its respective opposed lateral boundaries by a side sheet 22 and side slope sheets 30, and at each of its respective opposed longitudinal boundaries by a combination of slope sheets 38, upper bulkhead members 26, and/or vertical interior well walls 40. The particular combination may depend on the number of cargo wells 36 in the hopper car 10. For example, referring to FIG. 1B which shows an exemplary hopper car 10 having three cargo wells, the inner one of the three cargo wells 36 is bounded laterally by opposed side slope sheets 30 and side sheets 22 (shown for example, in FIG. 2), and bounded longitudinally by opposed pairs of slope sheets 38 and vertical interior well walls 40. Similarly, each of the two outer cargo wells 36 is bounded laterally by opposed side slope sheets 30 and side sheets 22, and bounded longitudinally on one side by both a slope sheet 38 and an upper bulkhead member 26, and both a slope sheet 38 and a vertical interior well wall 40 on the other side. Furthermore, though the exemplary hopper car 10 as seen in FIG. 1B includes outer ones of the slope sheets 10 that are longer than the interior ones of the slope sheets, and includes upper bulkhead members 26 and vertical interior well wall members 40 so as to define cargo wells of a uniform size, these are merely design considerations; other hopper cars constructed in accordance with the present disclosure may, for example, include slope sheets of uniform size and slope, and/or may eliminate the upper bulkhead members 26 and vertical interior well wall members 40, such as would be feasible in an uncovered hopper car, for example. Finally, each of the cargo wells may be enclosed at its lower boundary by a respective floor section 42 having a selectively openable and closeable discharge outlet (not shown) activated by a release member (not shown). The release members may be capable of independent activation, coordinated activation, or both.

Figure 3:
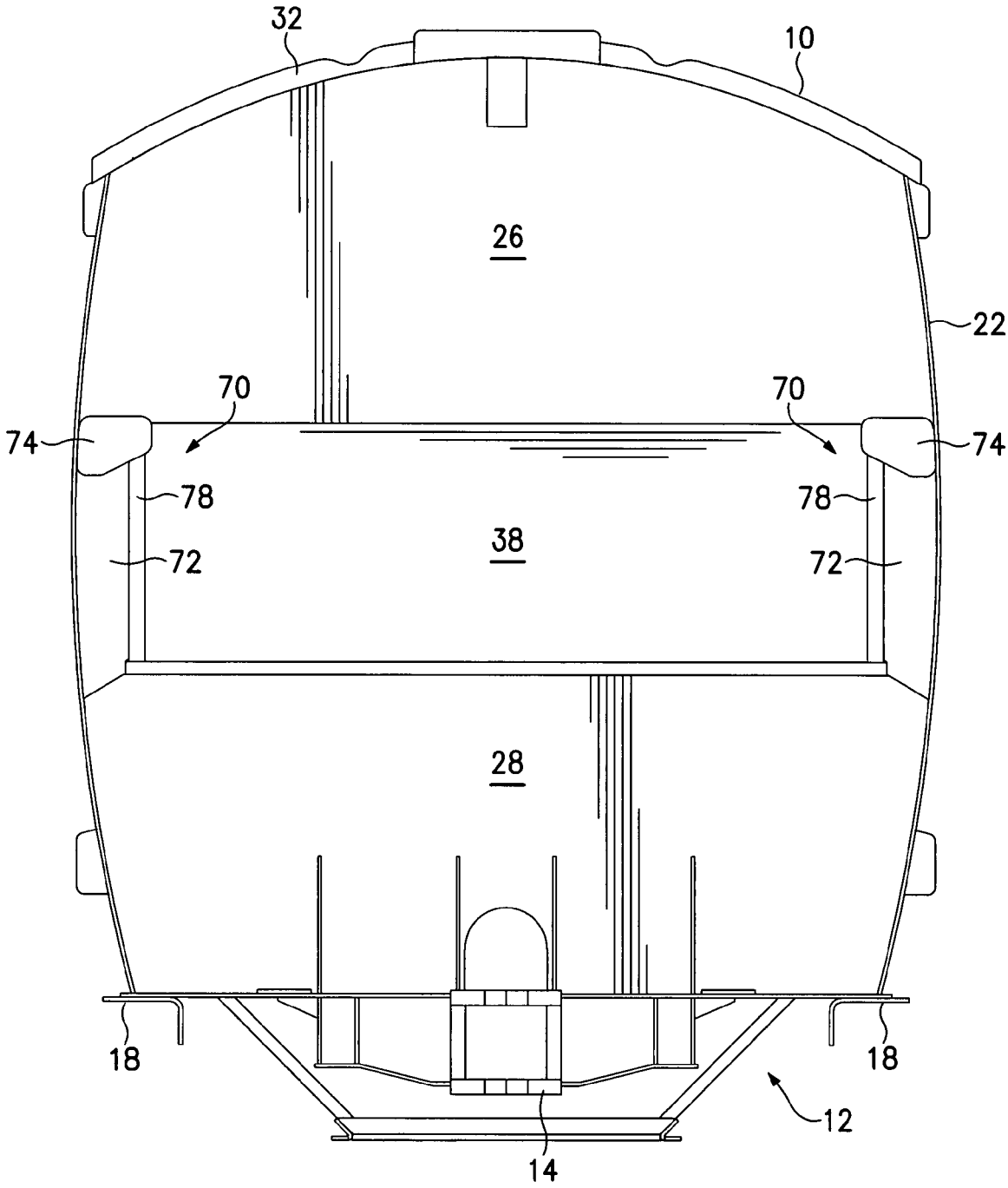
FIG. 3 is an end view of the hopper car of FIG. 1 showing a plurality of valley closure members.
Figure 4:
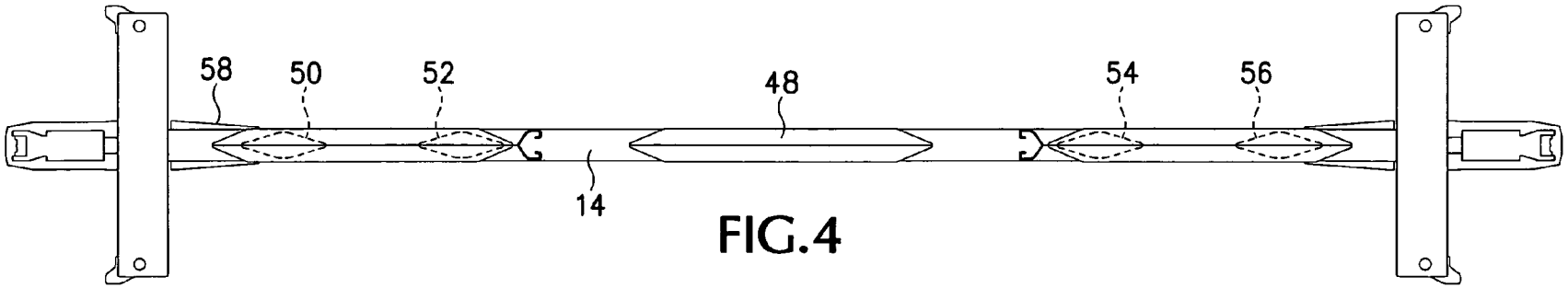
FIGS. 4-6 are top, side, and bottom views, respectively, of the center sill of the hopper car of FIG. 1 showing a plurality of center sill reinforcement members, a plurality of center sill hood segments, and a plurality of hood connector members.
Figure 5:
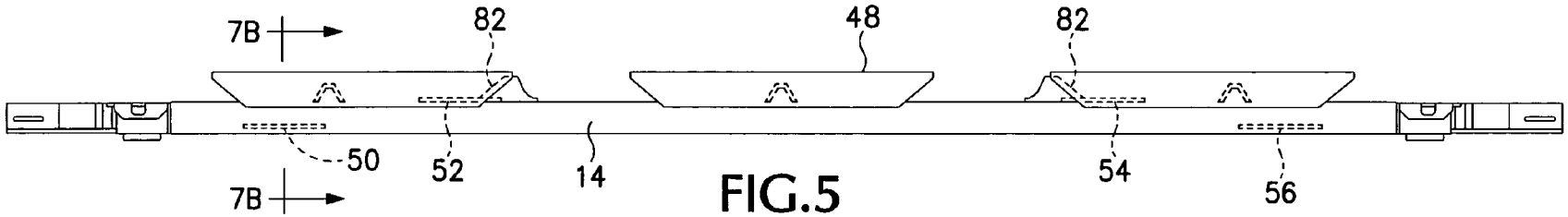
Figure 6:
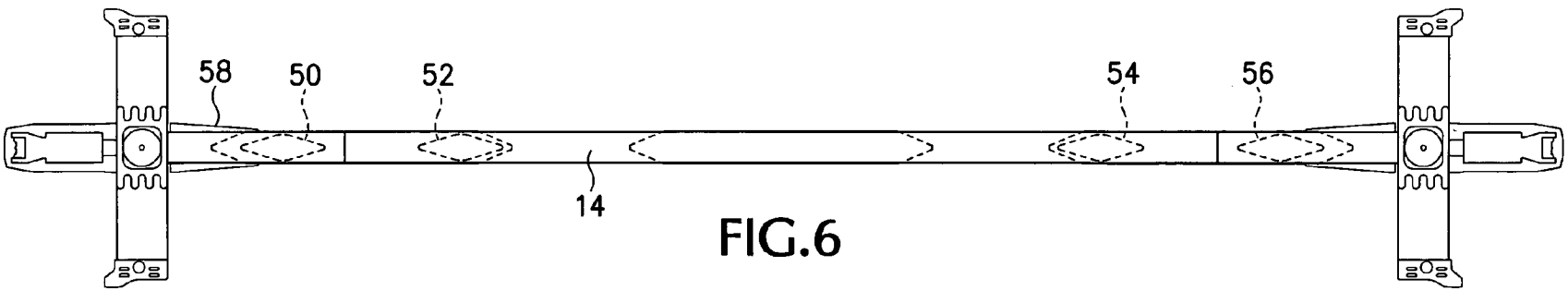

The hopper car 10 may include a center sill 14 that extends longitudinally through each of the cargo wells 36 included in the hopper car 10, hence each of the slope sheets 38 as well. Referring to FIGS. 3 and 7B, the center sill 14 may be fabricated by welding together four elongate pieces 46*a*, 46*b*, of steel, iron, or other appropriate material to form a center sill 14 having a substantially square cross section. The welding may be accomplished by flux-cored arc welding along substantially the entire longitudinal length of each of the intersection lines between adjoining pieces 46*a*, 46*b*, and welded in accordance with the applicable standards of the American Welding Society. In addition, the center sill 14 may optionally be reinforced by a desired number of internal gussets (not shown). The center sill 14 may be covered by triangular-shaped center sill cover sections 48, each extending between adjacent opposed pairs of slope sheets 38.

As noted earlier, existing hopper cars include load-bearing structural members, like the center sill 14, side walls 22, etc., made of chosen materials and desired thicknesses that are calculated to sufficiently to withstand the full loads and stresses anticipated for weight and cargo-carrying capacity of the hopper car. Thus, for a hopper car of a given cargo capacity, by volume and weight, conventional wisdom is that either reducing the thickness of the material comprising the load-bearing structural materials, or replacing those materials with lighter-weight substitutes, would unacceptably weaken the hopper car so as to make it susceptible to failure due to load-induced stresses such as bending or torsion stresses.

The present inventors re-considered this prevailing wisdom. After evaluating hopper cars having load-bearing structural members of varying weights and/or sizes, including those having weights and/or sizes less than what would be expected to withstand the dynamic loads of the cargo they carry, the present inventors discovered that, while the smaller/lighter hopper cars did indeed tend to fail due to the predicted stress, they tended to do so at common locations. Consequently, the present inventors came to the novel realization that reducing the weight of load-bearing structural members, and simultaneously reinforcing those lightweight structural members at locations empirically discovered to accumulate stress, permits the design of a structurally sound hopper car that is lighter and/or smaller in length than existing hopper cars that are designed to carry a corresponding amount/weight of cargo.

Referring to FIGS. 1B, 4-6, and 7B, the hopper car 10 may include a center sill 14 that is lighter and/or shorter than those of existing hopper cars of similar carrying-capacity. In a first embodiment, the center sill 14 is lighter than those of existing hopper cars of similar carrying-capacity. Specifically, the center sill 14 may be formed of members 46*a*, 46*b* that are each less than 9/16 inch in thickness throughout their respective lengths. It should be understood that the thicknesses of the respective members 46*a*, 46*b* may vary over the length of the center sill. For example, the thicknesses of the lower member 46*b* of the center sill may be approximately ½ inch thick at its respective longitudinal ends, but narrow to approximately ⅜ inch thick on portions inside the cargo wells 36. The members 46*a* in the described embodiment are about 13±1/16 inches wide. The members 46*b* in the described embodiment are about 11-¾±1/16 inches wide. Each of the members 46*b* may be inset with respect to the members 46*a*, such that members 46*a* form a lip about ⅜ inches thick beyond each of the members 46*b*. The center sill 14 may also include a center sill bottom cover gusset 58.

In one embodiment, each of the members 46*a*, 46*b* are formed of steel and are of a similar thickness of approximately 5/16-inch. In another embodiment, the members 46*a* and 46*b* may have a thickness different from the other, e.g. the members 46*a* may be approximately 5/16-inch thick while the members 46*b* may be approximately 3/8-inch thick. As used in this specification, the term "approximately" is intended to encompass a range of ±10%. The center sill 14 may extend through the length of the hopper car 10, passing through each of the slope sheets 38. At each intersection point between the center sill and the slope sheets 38, a slope sheet reinforcement member 48 may structurally connect, via a weld, the center sill 14 to the respectively intersecting one of the slope sheets 38.

Referring to FIGS. 4-7, as one method of achieving the desired structural strength of the hopper car 10 having a center sill 14 having dimensions as described in the preceding paragraph, the center sill of the disclosed rail car may be reinforced in several respects. First, the present inventors discovered that when the weight of the center sill was reduced as compared to existing hopper cars, an undesirable amount of stress accumulated at some, but not all of, the intersection points between the center sill and slope sheets. Accordingly, the disclosed hopper car may include diamond-shaped center sill reinforcement members such as 50, 52, 54, and 56 shown in FIGS. 4-6. These center sill reinforcement members 50, 52, 54, 56 are welded to, and reinforce, the center sill 14. Each of the center sill reinforcement members 50, 52, 54, 56 may be at least approximately 3/16 inches thick, and 36 inches in length and 11 inches in width measured across the longitudinal and transverse centerlines of the reinforcement members, respectively. Other embodiments, however, may include smaller, thicker reinforcement members 50-56, or larger, thinner reinforcement members 50-56, and it should be understood that the particular dimensions selected for the reinforcement members will also vary with the desired maximum load-carrying capacity of the hopper car 10 For example, the disclosed hopper car 10 has a maximum load-carrying capacity of approximately 224,500 lbs. Although the disclosed embodiment of the hopper car 10 includes center sill reinforcement members each having approximately the same thickness, other embodiments may use center sill reinforcement members of different thicknesses, or center sill reinforcement members each having a varying thickness. Furthermore, while the reinforcement members are shown to be diamond-shaped, they may be configured in any other appropriate configuration.

A respective one of the reinforcement members 50-56 may reinforce the center sill 14 at a longitudinal location corresponding to each of those intersection points that are between the center sill 14 and each of the slope sheets 38 of the two outermost cargo wells 36 of a three-well hopper car 10. In a more specific embodiment, at the intersections between the outermost slope sheets 38 of the outermost cargo wells 36, respectively, center sill reinforcement members 50, 56 may respectively reinforce the lower one of the two members 46*b* of the center sill 14, i.e. the bottom member of the rectangular center sill 14. At the intersections between the innermost slope sheets 38 o the outermost cargo wells 36, respectively, center sill reinforcement members 52, 54 may respectively reinforce the upper one of the two members 46*b* of the center sill 14, i.e. the upper member of the rectangular center sill 14. It should be understood that, where a hopper car includes more or less than three cargo wells 36, reinforcement may occur at different locations; however, it is advantageous to reinforce the center sill 14 at longitudinal locations corresponding to a number of intersection points between the slope sheets and the center sill fewer than the total number of such intersection points. In other words, it is desirable to include reinforcement members at some, but not all of the longitudinal locations corresponding to intersection points between the center sill and slope sheets.

In another embodiment, the center sill may be not only be lighter than those of existing hopper cars, but shorter as well, thus permitting the hopper car 10 to have side sills that are shorter than those of existing hopper cars. Such dimensions reduce the weight of the hopper car 10 even further.

Referring to FIGS. 2 and 10-12, the disclosed hopper car 10 may include well connectors 60 of a generally triangular shape with one or more flattened points that interconnect adjacent wells 36. In order to reduce the weight of the hopper car 10, each of the well connectors 60 may define a substantially circular central opening 62. As can be specifically seen in FIGS. 10-12, the perimeter of the opening 62 may be reinforced by a hoop member 64 so as to avoid stresses that accumulate around the periphery of the central opening 62. This permits the weight of the well connector 60 to be reduced, relative to a solid connector, while maintaining the stress resisting capabilities of a solid connector member. The rim of the hoop member 64 may have a lateral thickness of 3/16 inches and may enclose an opening having a diameter slightly larger than that of the central opening 62 of the respective well connector 60 that it reinforces, as can be specifically seen in FIG. 12. The hoop member 64 may be welded to the surface of the respective well connector 60 that it reinforces.

Each well connector 60 may have a lower length, oriented longitudinally along that of the hopper car 10, equal to the spacing between adjacent slope sheets 38 of different wells 36. In the described embodiment, this lower length is about 76 inches. Each of the well connectors 60 also may include plural sloped ledges 66 angled so as to facilitate welding each of the ledges 66 to a respective slope sheet. The opening 62 may have a diameter of approximately 20 inches, although some embodiments may increase or decrease the size of the opening 62. In particular, some embodiments may eliminate the necessity for the hoop member 64 by sufficiently reducing the size of the opening 62. For example, without a hoop member 64 the size of the opening 62 could be 12 inches.

Figure 9:
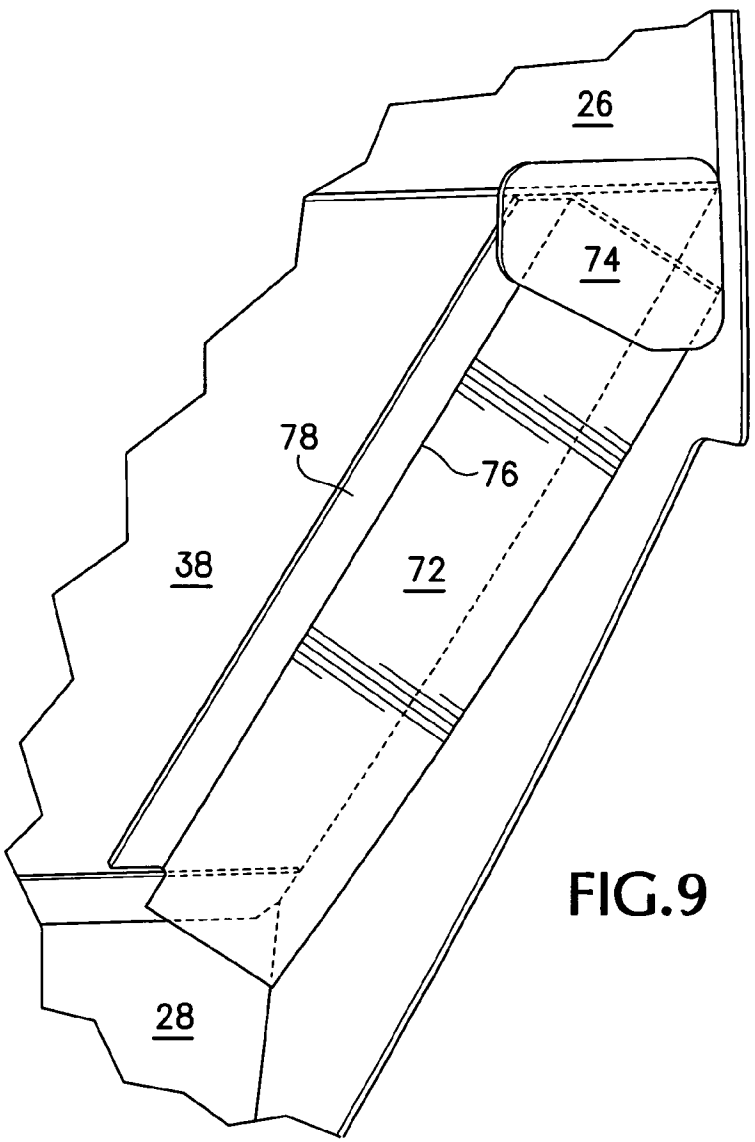
FIG. 9 is a sectional view of the valley closure member taken along line 9-9 in FIG. 8.
Figure 8:
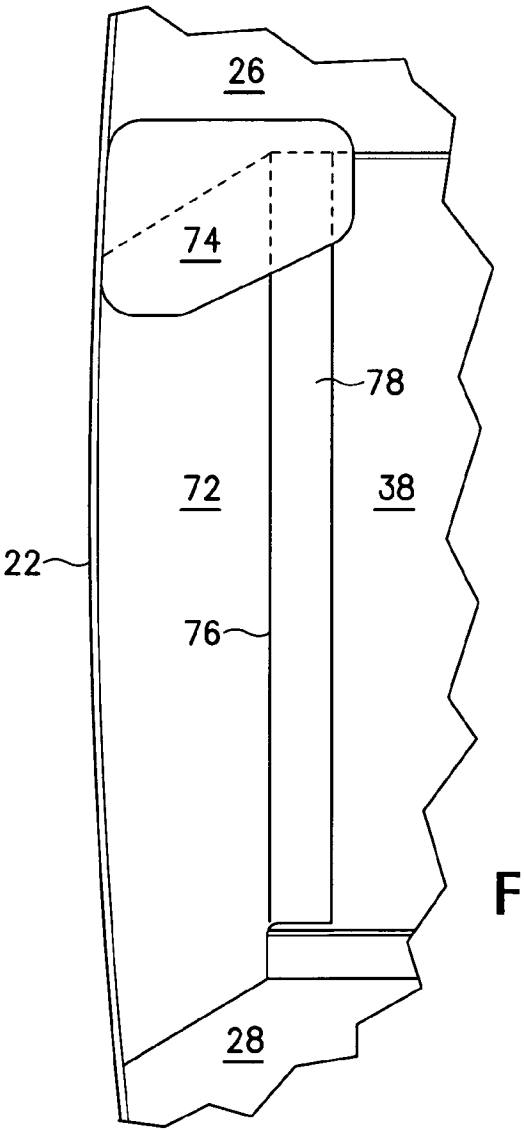
FIG. 8 is a cutaway view of the end sheets of the hopper car of FIG. 1, showing an enlarged version of the valley closure member shown in FIG. 3.

Referring to FIGS. 3, 8, and 9 the disclosed hopper car may include valley closure assemblies 70 to distribute stress between the ends and the sides of the rail car. The side sheets 22 of the disclosed hopper car, including the side slope sheets 30, extend rearwardly beyond the upper and lower bulkheads 26 and 28, respectively, as well as the outer slope sheets 38 of the hopper car 10. The valley closure assemblies 70 each respectively connect the edge of a side sheet 22 to a respective outer slope sheet 38 so as to distribute stress between these two members. Each of the valley closure assemblies 70 may include a valley plate 72 and a valley closure 74. The valley plate 72 may include a fold 76 defining a tab portion 78 bent with respect to the remainder of the valley plate 72. In the described embodiment, the bend of the tab portion 78 with respect to the remainder of the valley plate 71 is at an approximate angle of 156 degrees, however other embodiments having valley plates with tab portions may have bends at other angles. The tab portion 78 has a substantially planar surface that is welded flush with the slope sheet 38 and is welded at it's upper edge with the valley closure 74. This latter weld may advantageously continue along the remainder of the intersection of the valley closure 74 and the valley plate 72.

The valley closure 74 may be welded to both the side sheet 22 and the upper bulkhead 26 and may comprise a steel plate 3/16 inches thick.

In the described embodiment, the valley plate 72 may be pressed from a steel sheet or other such sturdy member having a thickness of approximately 3/16-inch, a length of approximately 55-3/4 inches, and a width of approximately 10-5/8 inches. After the valley plate is pressed through the angle of 156 degrees, as specified earlier, the valley plate 72 may have a net width (with the fold 36) of approximately 10-3/4 inches, where the tab portion is approximately 2-7/16 inches.

Figure 7A:
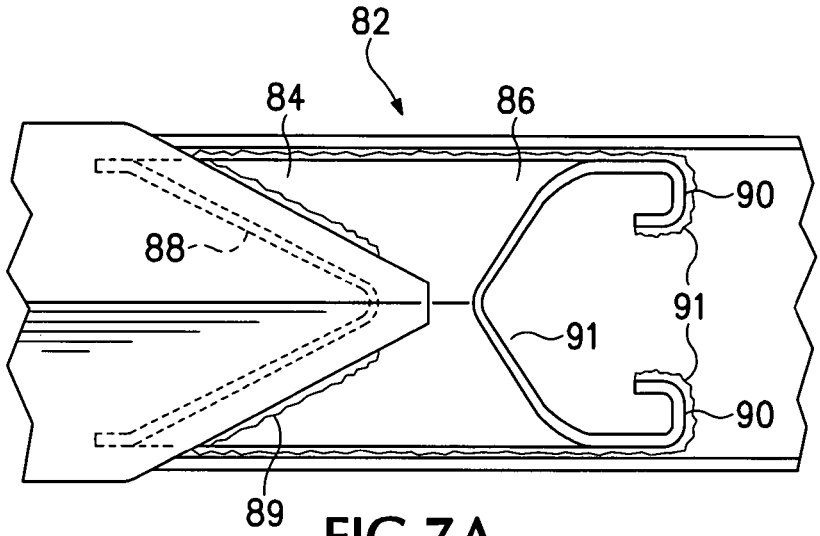
FIG. 7A is an enlarged top view of a hood connector member shown in FIGS. 4-6.
Figure 7B:
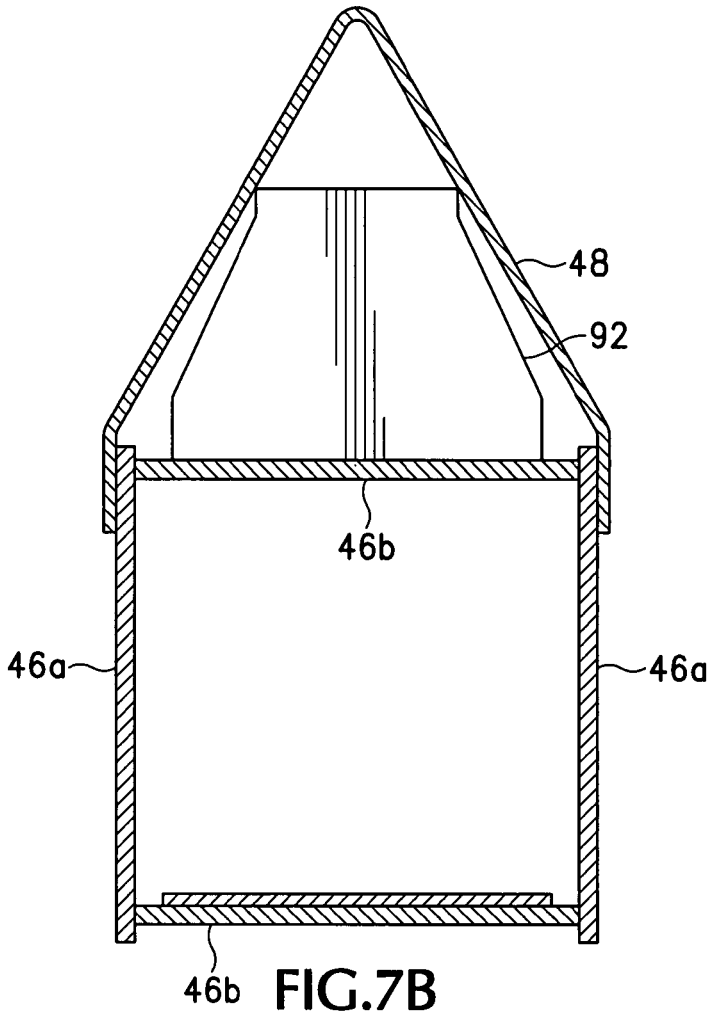
FIG. 7B is a cross section taken along line 7B-7B of FIG. 5.

Referring specifically to FIGS. 4-6, 7A and 7B, angled hood members 48 may cover the center sill 14, between adjacent slope sheets 38 of respective cargo wells 36, so as to facilitate the unloading of cargo through the bottom of the cargo wells 36. The disclosed hopper car 10 may include hood connectors 82 shaped to interconnect the center sill 14 with respective hood members 48 at one or more locations proximate the intersections between respective hood members 48 and the slope sheets 38. Referring specifically to FIG. 7A, each hood connector 82 may include a first end 84 having an upwardly-facing, slanted first surface 88. The angle of the upwardly slanted first surface 88, with respect to the longitudinal center sill, may correspond to the angle of the slope sheets 38, which the respective hood members 48 intersect, so as to maximize the area over which a weld may connect, and reinforce, the intersection between a respective hood connector 82 and the hood member it reinforces. For example, in the embodiment shown, the weld may be along line 89 as shown in FIG. 7A. Similarly, each hood connector 82 may have a downwardly tapered second end 86 having a lower surface that may press against, and be welded to the center sill 14. The downward taper of the respective hood members also increases the contact area between the respective hood connectors 82 and the center sill, thereby increasing the strength of the weld between those two members. Also, rather than having a weld that terminates at the outer lateral edge of the center sill, each elongated segment 90 of the downwardly tapering second end 86 preferably includes a bend that curves inwardly, as shown in the detail view of FIG. 7A, with the weld continuing along a major portion, if not substantially all, of the inwardly curved section. With attachment in this manner, stresses do not accumulate at the outer lateral edges of the center sill 14.

The combination of the hood connectors 82 and the exemplary diamond-shaped reinforcement members 50-56 permits the center sill 14 of the disclosed hopper car 10 to be of a lighter fabrication than those of existing hopper cars, while maintaining a load carrying capacity comparable to those existing cars without debilitating stresses accumulating along the center sill 14.

Figure 13:
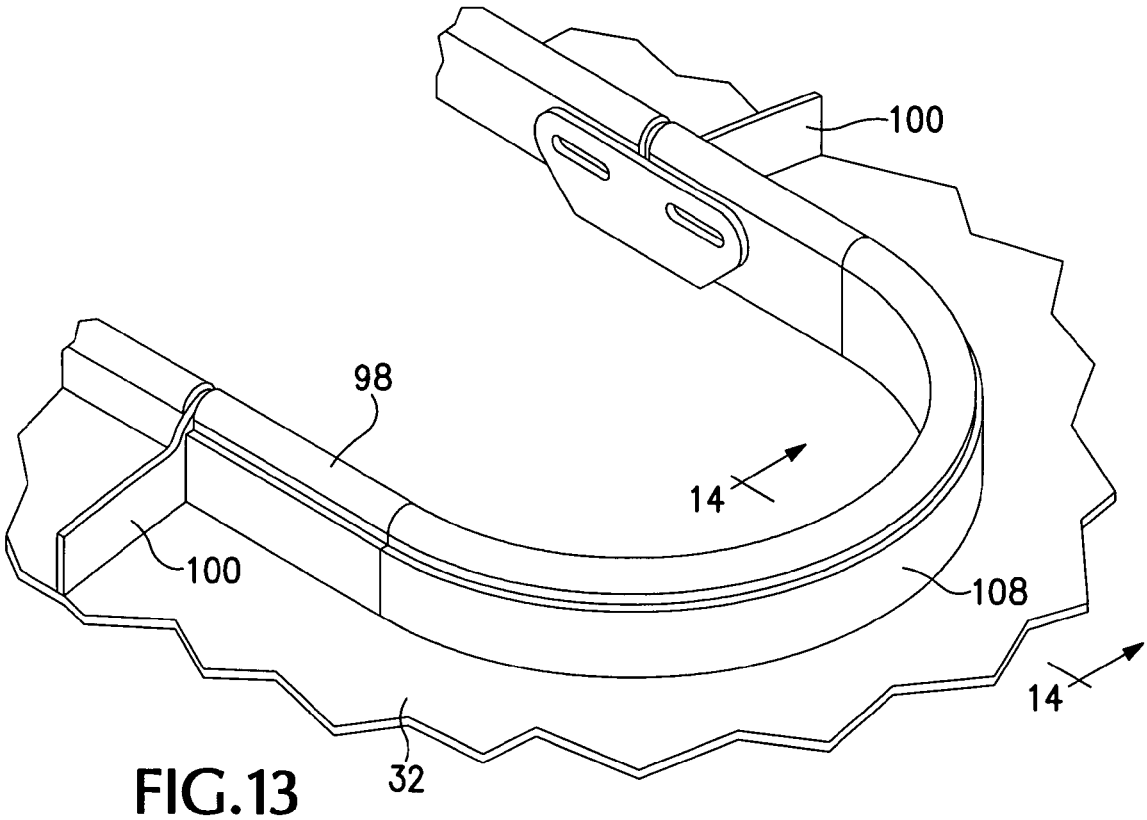
FIG. 13 is a perspective view of an end combing seal on the cover of the hopper car of FIG. 1, showing a novel combing closure plate.
Figure 14:
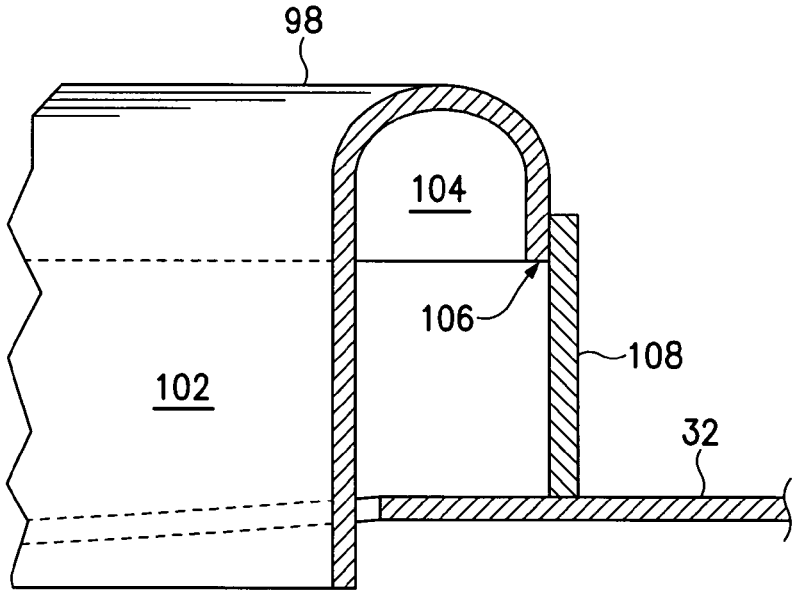
FIG. 14 is a sectional view of the end combing seal of FIG. 13 taken along line 14-14 in that figure.

Referring to FIGS. 1, 13 and 14, the disclosed hopper car 10 may include a roof 32 with an opening 34 for loading cargo, along with a selectively openable and closeable hatch (not shown) to selectively provide access to the cargo wells 36 during loading of cargo, while protecting the cargo from the elements during transport. The opening 34 in existing hopper cars is typically of an elongate oval shape, with curved portions 96 at each longitudinal end of the opening. The present inventors discovered that an undesirable amount of stress would accumulate along those curved portions 96. Specifically, the disclosed hopper car, like some existing hopper cars, includes an end combing seal 98 around which the door may close. The end combing seal 98 typically extends between each of a pair of carlines 100 on laterally opposite sides of the hopper car. The end combing seal 98, seen in cross section as shown in FIG. 14, typically includes a leg portion 102, welded to the roof 32, and from which a closure seal 104, curved to define a downwardly-directed channel, extends. The upwardly-directed, curved surface of the closure seal 104 provides the sealing surface for the hatch (not shown), when closed. The closure seal 104 also defines a downwardly-facing lower surface 106 vertically spaced apart from the roof 32, i.e. the end of the channeled closure seal 104 is spaced above the roof 32. To reduce stress, the disclosed hopper car includes a combing closure plate reinforcement 108 welded to the closure seal 104 and the roof 32 of the hopper car 10. The combing closure plate reinforcement 108 is 1/4 inches thick, and extends around the periphery of the curved portions 96 of the opening 34, between the respective carlines 100.

Many existing freight railcars, including but not limited to box cars and hopper cars, are constructed so as to reduce the weight of the car as much as is practicable. Accordingly, the side sheet material is only so thick as to provide the overall structural strength to support the static and dynamic loads for which the rail car is designed. In covered hopper cars, the side sheet material may include a plurality of curved side sheets welded together to form a side wall of the covered hopper rail car. Unfortunately, although the thickness of the side sheets is sufficient to provide the requisite strength for the anticipated loads for which the car is designed, the thickness of the side sheets is often not enough to prevent warping of the side sheets and other structural members due to the heat produced when side sheets are welded to either adjacent side sheets, or side posts, side sills, etc. This warping is often undesirable, yet adding to the thickness of the side sheets, sufficient to prevent such warping is problematic in that it adds to the weight of the hopper car, which in turn adds to the static and dynamic stresses on other structural members of the car, such as the center sill, end sills, etc., which need further reinforcement, thus adding to the weight of the car, etc.

Figure 2A:
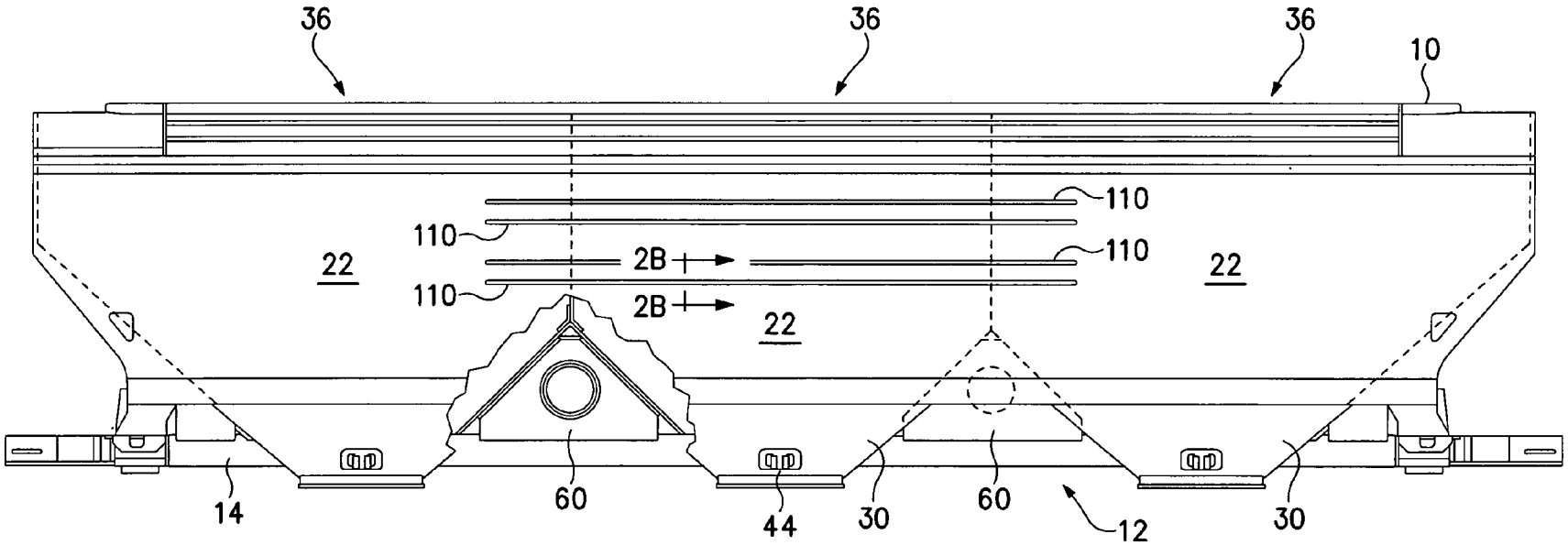
FIG. 2A is a side view of the hopper car of FIG. 1 showing a center sill hood and a plurality of cargo well reinforcing connectors.
Figure 2B:
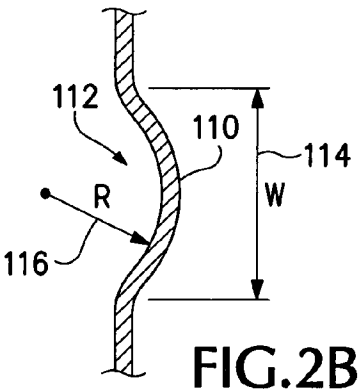
FIG. 2B is a cross section taken along line 2B-2B of FIG. 2A.

Referring to FIG. 2, the disclosed hopper car 10 may include a plurality of stiffening ribs 110 across one or more of the side sheets 22 so as to reinforce selective ones, or all of, the side sheets 22 and resist the warping stresses due to welding the side sheets during the rail car fabrication process. In one embodiment, the stiffening ribs 110 may be welded to the outer surface of the side sheets 22, however this procedure will add unwanted weight to the car and may cause further warping due to the heat input of welding the stiffening ribs 110 to the side sheets 22. Therefore, in another embodiment, the stiffening ribs 110 may be formed within a side sheet 22 through any appropriate bending process, such as pressing the stiffening ribs 110 into the side sheet 22.

Referring to FIG. 2A, when stiffening ribs 110 are formed within the side sheets 22, the ribs 110 may comprise a long dimple 112 formed into the sheet 22 having a longitudinal axis parallel to a longitudinal axis of the railcar. These stiffening ribs 110 add enough structural strength to the side sheets 22 to resist the heat distortion caused by welding the side sheets 22 to other members, resulting in a smoothly sided covered hopper car, while avoiding the addition of weight to the rail car 10. The side 22 may be made of steel that is 3/16 inch thick and the rib 110 may include a dimple 112 having a width 114 of approximately 2 1/16 inch, and an inner radius 116 of 2 7/16 inches. The dimple 112 is shown to protrude outwardly from the railcar, though the dimple 112 could also protrude inwardly. Other dimple widths and radii may also be used.

When stiffening ribs 110 are welded to side sheets 22, they may extend longitudinally across multiple adjacent side sheets 22, as shown in FIG. 2, so as to reduce warping in all the side sheets the stiffening ribs reinforce. Conversely, when stiffening ribs are formed within adjacent side sheets 22, the stiffening ribs 110 in adjacent side sheets are positioned vertically with respect to the rail car 10 so as to, together, provide a continuous rib, once the side sheets are welded together.

In addition, it should be appreciated that, although the disclosed ribs 110 are shown as being incorporated into a hopper car, such as the exemplary hopper car 10, such ribs may also be incorporated into other rail car types, including but not limited to box cars, etc. Further, though FIG. 2 shows four stiffening ribs, other numbers may be used, as appropriate, such as two and three rib configurations. However, the inventors have discovered that, when using ribs 110 formed within the side sheets 22 themselves, fewer stiffening ribs 110 will be needed to avoid warping from the heat of welding.

The terms and expressions that have been employed in the foregoing specification are used therein as terms of description and not of limitation, and there is no intention, in the use of such terms and expressions, of excluding equivalents of the features shown and described, or portions thereof. Furthermore, those skilled in the art will appreciate that the structures described herein can be implemented in many different variations, and although exemplary embodiments are specifically illustrated herein, it should be understood that modifications and variations of the exemplary rail car 10 may be employed; thus, the scope of any inventions individually claimed are respectively defined and limited only by the terms of the respective claims that follow.

What is claimed is:

1. A hopper car comprising:

(a) a center sill passing through a plurality of cargo wells and oriented longitudinally with respect to the hopper car, the center sill having an upper member and a lower member parallel to the upper member, and at least one hood member affixed to said upper surface that directs fluid cargo in a said cargo well around said center sill;

(b) each cargo well being at least partially bounded by: (i) a respective pair of opposed slope sheets transverse to and intersecting the center sill at respective intersections; (ii) a respective pair of side sheets each extending between opposed slope sheets on a respective side of the center sill; and (iii) a selectively openable floor; and (c) a plurality of reinforcing members, each positioned beneath a respective said hood member, each reinforcing member being located adjacent the upper member and each reinforcing member being located adjacent a respective intersection, wherein the number of the reinforcing members is less than the number of the intersections at said upper member; wherein (d) each of said intersections is characterized, relative to each other, by the junction of said center sill with a different respective one of said slope sheets.

2. The hopper car of claim 1 comprising a plurality of second reinforcing members, each adjacent the lower member of the center sill and each adjacent a respective intersection, wherein the number of the second reinforcing members is less than the number of the intersections.

3. The hopper car of claim 1 where each side sheet has a sloped portion.

4. The hopper car of claim 1 where each sloped portion is supported by a substantially vertical portion of the side sheet.

5. The hopper car of claim 1 where the hopper car has three cargo wells, and where the intersections associated with one of the cargo wells do not have adjacent reinforcement members.

6. A hopper car comprising:

(a) a center sill passing through a plurality of cargo wells and oriented longitudinally with respect to the hopper car, the center sill having an upper member and a lower member parallel to the upper member, and at least one hood member affixed to said upper member that directs fluid cargo in a said cargo well around said center sill;

(b) each cargo well being at least partially bounded by: (i) a respective pair of opposed slope sheets transverse to and intersecting the center sill at respective intersections; (ii) a respective pair of side sheets each extending between opposed slope sheets on a respective side of the center sill; and (iii) a selectively openable floor; and (c) a plurality of reinforcing members, each positioned beneath a respective said hood member, each second reinforcing member being located adjacent the lower member and each second reinforcing member being located adjacent a respective intersection, wherein the number of reinforcing members is less than the number of the intersections; wherein (d) each of said intersections is characterized, relative to each other, by the junction of said center sill with a different respective one of said slope sheets.

7. The hopper car of claim 6 comprising a plurality of second reinforcing members, each second reinforcing member adjacent the upper member and each second reinforcing member adjacent a respective intersection, wherein the number of reinforcing members is less than the number of the intersections.

8. The hopper car of claim 6 where each side sheet has a sloped portion.

9. The hopper car of claim 6 where each sloped portion is supported by a substantially vertical portion of the side sheet.

10. The hopper car of claim 6 where the hopper car has three cargo wells, and where the intersections associated with one of the cargo wells do not have adjacent reinforcement members.

11. A hopper car comprising:

(a) a center sill passing through three contiguous cargo wells and oriented longitudinally with respect to the hopper car, and at least one hood member affixed to said center sill that directs fluid cargo in a said cargo well around said center sill;

(b) each cargo well being at least partially bounded by: (i) a respective pair of opposed slope sheets transverse to and intersecting the center sill at respective intersections; (ii) a respective pair of side sheets each extending between opposed slope sheets on a respective side of the center sill; and (iii) a selectively openable floor;

(c) a plurality of reinforcing members, each positioned beneath a respective said hood member, each reinforcing member being located adjacent a respective intersection, wherein the intersections associated with the longitudinally outer cargo wells have adjacent reinforcement members and the intersection points associated with the inner cargo well do not have adjacent reinforcement members; wherein (d) each of said intersections is characterized, relative to each other, by the junction of said center sill with a different respective one of said slope sheets.

12. The hopper car of claim 11 where each reinforcement member comprises a pair of members respectively welded to opposed upper and lower surfaces of the center sill.

13. The hopper car of claim 11 where each side sheet has a sloped portion.

14. The hopper car of claim 11 where each sloped portion is supported by a substantially vertical portion of the side sheet.

15. A hopper car comprising:

(a) a center sill oriented longitudinally with respect to the hopper car;

(b) each cargo well at least partially bounded by a respective pair of opposed slope sheets transverse to the center sill;

(c) a roof defining an upper aperture into the hopper car, the roof defining an upwardly directed surface, the aperture surrounded by an end combing seal having a leg portion and a downwardly directed channel portion integral with the leg portion, the channel portion having a terminus vertically spaced apart from the upwardly directed surface; and (d) a reinforcement extending from, and contacting, the terminus of the channel portion to the upwardly directed surface at a location spaced apart from said leg portion.

* * * * *